United States Patent [19]

Zacherl

[11] 4,385,864

[45] May 31, 1983

[54] SEALING DEVICE FOR THE FREE ENDS OF VARIABLE STATOR VANES OF A GAS TURBINE

[75] Inventor: Anton Zacherl, Munich, Fed. Rep. of Germany

[73] Assignee: Motoren und Turbinen Union Munchen GmbH, Munich, Fed. Rep. of Germany

[21] Appl. No.: 173,235

[22] Filed: Jul. 28, 1980

[30] Foreign Application Priority Data

Aug. 4, 1979 [DE] Fed. Rep. of Germany ..... 2931766

[51] Int. Cl.[3] ..... F01D 11/08

[52] U.S. Cl. ..... 415/136; 415/113; 415/174

[58] Field of Search ..... 415/91, 113, 135, 136, 415/139, 149, 151, 160, 170, 171, 172 A, 174; 213/69 W

[56] References Cited

U.S. PATENT DOCUMENTS 3,529,906 9/1970 McLaurin ..... 415/113

3,999,883 12/1976 Nordenson ..... 415/113

*Primary Examiner*—Harvey C. Hornsby
*Assistant Examiner*—Arthur D. Dahlberg
*Attorney, Agent, or Firm*—Alan H. Levine

[57] ABSTRACT

A sealing device including a sealing ring extending around the periphery of a gas turbine stator section and located between the stator section and the free ends of the stator vanes. The sealing ring is formed of individual segments movable radially relative to each other. Each two adjacent sealing ring segments have opposed faces, one face presenting projections and the other having correspondingly shaped recesses for accommodating the projections with clearance. Each opposed face has a groove at least as deep as the projection or recess in that face, and a flat plate is located in the opposed grooves. Springs or gas pressure press the sealing ring segments radially outwardly against the free ends of the vanes. The radius of curvature of the ring segments outer surfaces is smaller than that of the vane ends so that the segments and vane ends contact each other over only a portion of their surfaces.

5 Claims, 5 Drawing Figures

SEALING DEVICE FOR THE FREE ENDS OF VARIABLE STATOR VANES OF A GAS TURBINE

The invention relates to sealing the free ends of vanes of a variable stator in gas turbines.

Until now, the free ends of the vanes of the variable stator in gas turbines have been provided with a gap seal, the dimensions of which are such that the thermal expansion of the vanes and/or other parts of the gas turbine, which has an effect on the size of the gap, is not restrained. Experiments have now shown that the size of the seal's gap has a not inconsiderable influence on the efficiency of the turbine, and it has indeed been shown that the efficiency increases as the gap becomes smaller. Because of this relationship between the width of the gap and efficiency, it is desirable that a contact seal be used for the ends of the vanes of a stator, instead of a gap seal. However, the desirability of using a contact seal at the ends of the vanes of the stator is countered by the requirement that the thermal expansion of the vanes and/or other parts of the gas turbine, which can reduce the size of the gap to be sealed, must not be restrained by the contact seal, since this can result under certain circumstances in the function of the stator being detrimentally affected.

With this problem as a starting point, the purpose of the invention is to provide a sealing device for the free ends of vanes of a gas turbine variable stator in such a way that the flow past the free vane ends can be virtually completely cut off without the damaging effect of restraining thermal expansion, which changes the size of the gap to be sealed.

The purpose of the invention is achieved by providing a sealing ring, arranged between a stator section and the free ends of the vanes, which is subdivided into radially movable segments that are sealed off from one another, and which together with the stator section form a seal. The segments are forced against the free ends of the vanes by spring pressure so that the outer faces of the segments are in contact with the free ends of the vanes, thereby forming a seal. The segments can be forced against the free ends of the vanes by a spring, which is supported by the stator section, or by compressed air or gas. If a spring is used, it is preferably in the form of a corrugated spring that is annular and divided into segments, with the opposing edges of the segments overlapping.

For forming the seal between the segments, in particular, between every two opposed segment faces, one face can be formed with two outward projections and the other with correspondingly shaped recesses, each projection engaging a recess in such manner that is has a clearance. Further, a groove is cut in each face of every pair of opposed faces, the depth of the groove at least corresponding to the depth of the recess or the length of the projection, and a flat plate is inserted in the space formed between the opposed grooves.

The intervening gap between the segments, arising as a result of the division of the sealing ring into segments, if possible should be of such a size that the faces of the segments are in contact both when the sealing ring increases in size and when it decreases in size. In order to attain this intervening gap, the size of which can be determined mathematically, the sealing ring is divided into segments by means of continuous-wire electro-erosion.

As a result of the segments being pressed against the ends of the vanes, friction naturally occurs when the vanes are actuated. In order to keep the frictional resistance at the vane ends as low as possible, the ends of the vanes are slightly less curved than the outer surfaces of the segments, with the result that each outer surface of a segment is only in partial contact with its respective vane end. This feature admittedly produces a gap outside the contacting surfaces of the segments and the vane ends, but this gap is so small that the flow through it is negligible.

A practical example of the invention is illustrated in the drawings and is described in greater detail below with reference to the drawings, in which.

Figure 1:
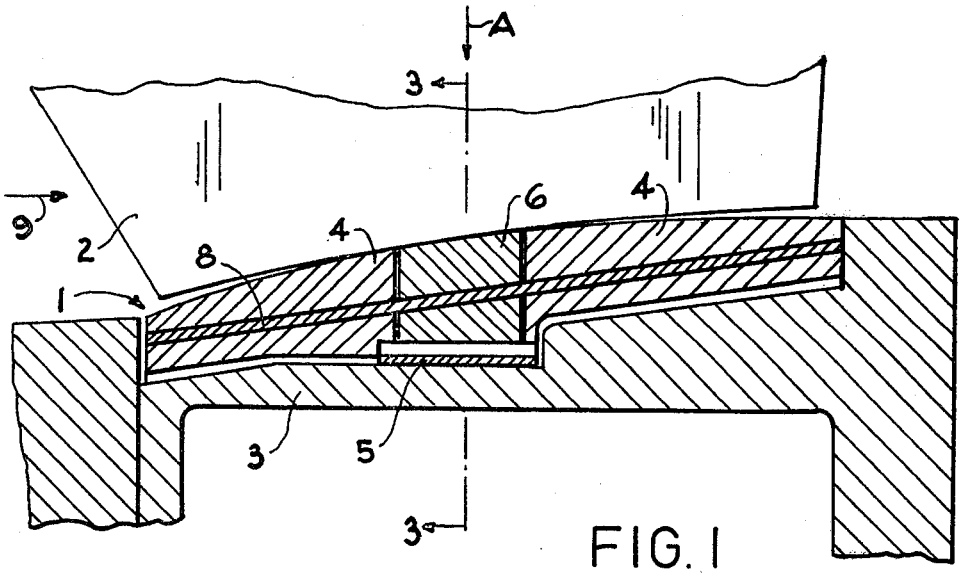
FIG. 1 is a fragmentary longitudinal cross-sectional view through a sealing device according to the invention in assembled condition, only that part above the turbine axis being shown since the part below would appear as the mirror image of the part shown.
Figure 2:
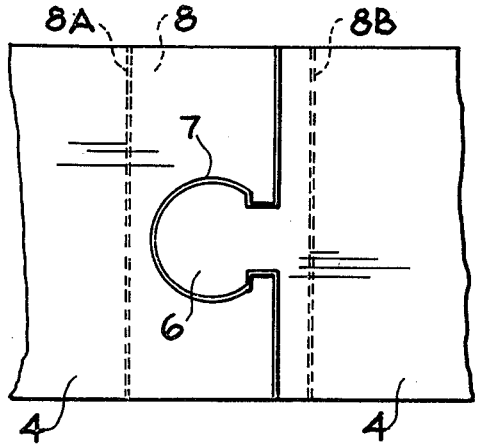
FIG. 2 is a view of two interconnected segment ends of the sealing device shown in FIG. 1, looking in the direction of arrow A in FIG. 1.
Figure 3:
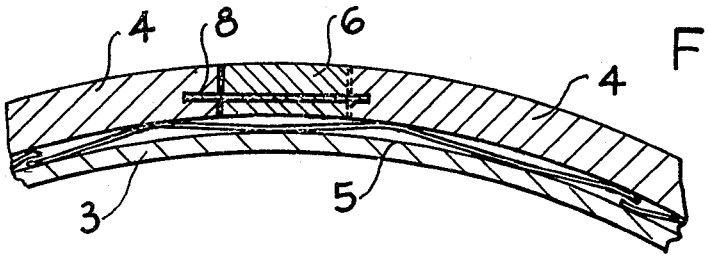
FIG. 3 is a cross-sectional view, along line 3—3 of FIG. 1, of a part of the sealing device shown in FIG. 1.

A sealing device 1, according to the invention, for the free ends of vanes 2 of a variable stator of a gas turbine for vehicles, is shown in FIGS. 1–3. The sealing device is arranged between the free ends of vanes 2 and an internal stator section 3 which is recessed for accommodating the sealing device 1. The sealing device 1 has a sealing ring divided into segments 4 that are radially moveable and that are forced against the vane ends 2 by a segmented, corrugated spring 5. The spring is located between the segments 4 and the bottom of the recess in the stator section 3, with the result that the outer surfaces of the segments 4 come into contact with the vane ends, by means of which a seal is formed between the vane ends 2 and the segments 4.

The direction of flow of the gas is indicated by an arrow 9. The downstream-side faces, running in the peripheral direction, of the segments 4 are in contact with the opposing wall of the recess in the stator section 3, with the result that a seal is also formed between the segments 4 and the stator section 3.

Of every two opposed surfaces, in the axial direction, of the segments 4, one has two tree-shaped projections 6, and the other correspondingly shaped recesses 7, in which the projections 6 are accommodated. Further, a groove 8A or 8B, running right across the relevant segment 4, is cut, in the axial direction, in every two opposed faces, respectively, of the segments 4. As can be seen in FIG. 2, the depth of groove 8A, cut in the face with the recess 7, is greater than the depth of recess 7, and groove 8B, cut in the face with the projection 6, is deeper than the projection 6 is long. A flat plate 8 is inserted in the space formed between each two opposed grooves 8A and 8B, the plate being nearly as wide as the two grooves 8A and 8B together are deep.

Each of the projections 6 with a tree-shaped contour and correspondingly shaped recesses 7 form a seal between the opposing faces of the segments 4, which prevents ingress of gas in the radial direction between segments 4.

In their circumference, projections 6 engaged in recesses 7 are somewhat smaller than the recesses to provide a clearance, so that the segments 4 are free to move radially. The segments 4 can move outwardly or inwardly sufficiently to allow the projections 6 to come into contact with appropriate points on the edges of the recesses 7. Since the extent of the radial movement of the segments 4, i.e., the circumferential expansion of the sealing ring, is determined by the thermal expansion of the vanes and other parts of the gas turbine, it is possible to calculate the intervening gap required between each two segments. In order to maintain the theoretical dimensions of the intervening gap when segmenting the sealing ring, the ring is segmented by continuous-wire electro-erosion.

The outer surfaces of the segments 4 are curved in the axial direction and the ends of the vanes are also curved. The curvature of the outer surfaces of the segments 4, however, is slightly greater than that of the vane ends, so that only the middle sections of the segments 4 are in contact with the ends of the vanes. This contact of only the middle section of each of the outer surfaces of the segments 4 with the vane ends means that the frictional resistance at the vane ends is appreciably less than would be the case if the whole outer surface of each of the segments was in contact with its respective vane end.

The opposed edges of the segments of the spring 5 are so shaped that the eges can overlap when the spring is compressed.

Figure 4:
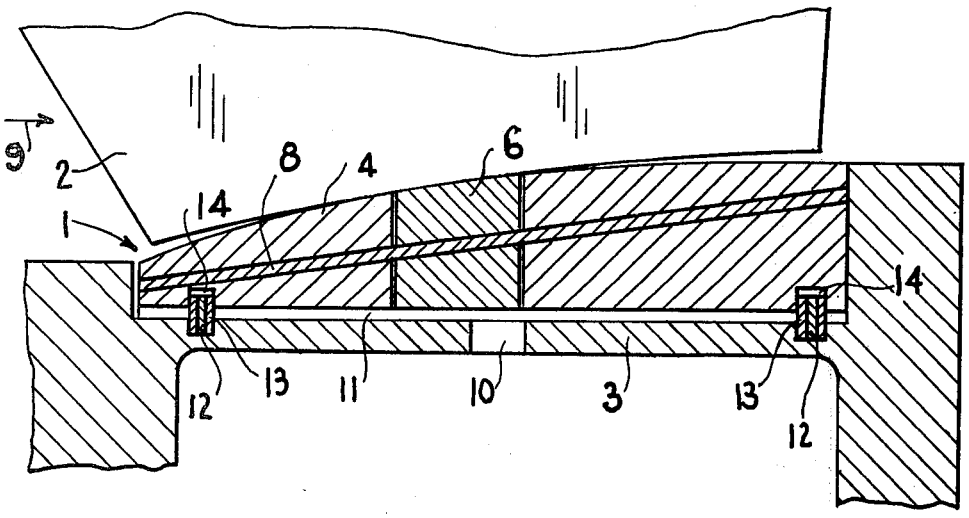
FIG. 4 is a longitudinal cross-sectional view of a modified sealing device.

A modified sealing device is shown in FIG. 4, wherein the same reference numerals as in FIG. 1 are used for those parts of the modified sealing device that are identical to the corresponding parts of the sealing device shown in FIG. 1.

In essence, the modification is that instead of using a spring 5, compressed air or gas impinges against the undersides of segments 4. The compressed air or gas is supplied via a hole 10 in the stator section 3 to a chamber 11, which is defined above and below by the underside of the segments 4 and the bottom of the recess in the stator section 3, respectively, and laterally by two sealing rings 12. Each sealing ring 12 consists of a pack of individual contiguous rings of rectangular cross-section. The internal edge of each sealing ring 12 is firmly engaged in an annular groove 13, formed in the bottom of the recess in the stator section 3. The external edge of each sealing ring 12 engages in a groove 14 formed in the undersides of the segments 4, whereby a sliding pack seal is formed between the opposing sides of the groove 14 and faces of the sealing ring 12.

Figure 5:
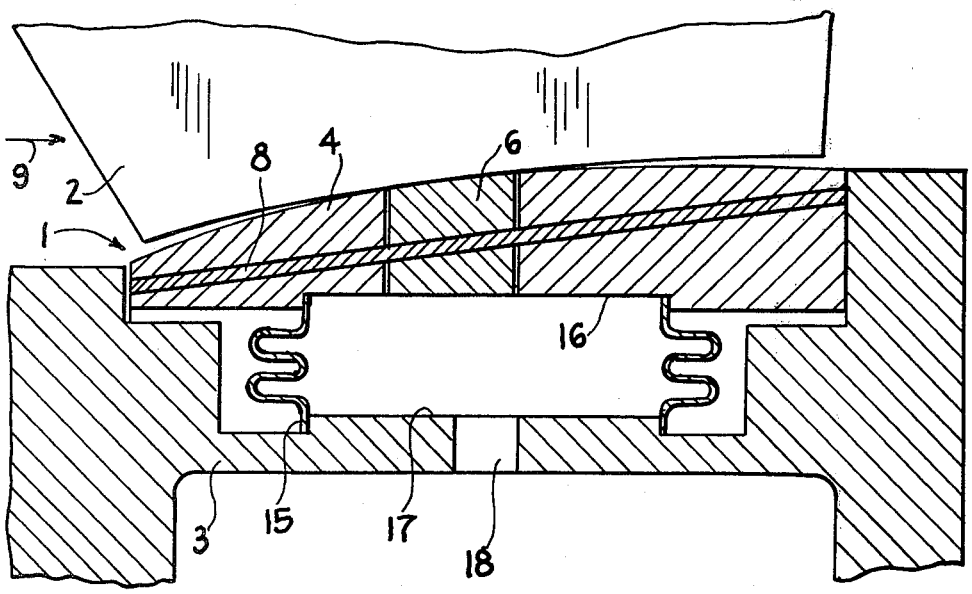
FIG. 5 is a longitudinal cross-sectional view of an alternative embodiment of the sealing device shown in FIG. 1.

A further modification of the sealing device can be seen in FIG. 5, where parts of the sealing device similar to those in FIG. 1 are identified by the same reference numerals as in FIG. 1.

In the sealing device of FIG. 5, instead of the spring 5, a metal bellows 15 of a high-temperature resistant material is used for each segment 4, the bellows being fitted in the recess in the stator section 3. In comparison with the spring 5, the metal bellows 15 has the advantage that it is strong enough to withstand higher temperatures than the spring 5. The bellows 15 is brazed at one end into an indentation 16 in the underside of the respective segment 4, the other end being engaged over a protrusion 17 in the bottom of the recess in the stator section and brazed to the stator section 3. A hole 18 in the stator section 3 in the vicinity of the protrusion 17 permits compressed air or gas to be supplied to the metal bellows 15.

It will be seen that a sealing device according to the invention ensures that the flowing medium is virtually totally prevented from flowing between the ends of the vanes of a variable stator and the stator section 3. This is true irrespective of whether the ends of the vanes move away from or towards the stator section 3, and regardless of the position of the vanes, related to the direction of flow of the gas, for the segments 4 are always urged against the vane ends by spring pressure or forced inwards against the spring pressure by the vane ends 2.

The invention has been shown and described in preferred forms only, and by way of example, and many variations may be made in the invention which will still be comprised within its spirit. It is understood, therefore, that the invention is not limited to any specific form or embodiment except insofar as such limitations are included in the appended claims.

I claim:

1. A sealing device for sealing the free ends of vanes of a variable stator of a gas turbine, the gas turbine also having a stator section, said sealing device comprising:

(a) a sealing ring extending around the periphery of the stator section and located between the stator section and the free ends of the vanes, the sealing ring being formed of individual segments arranged one behind the other in the circumferential direction of the stator, the segments being movable radially relative to each other, and each sealing ring segment having a face opposed to a face of an adjacent sealing ring segment, (b) means for providing a seal between each two adjacent sealing ring segments, said means including a projection extending from one opposed face of a sealing ring segment toward another opposed face of an adjacent sealing ring segment and a correspondingly shaped recess in the other opposed face accommodating the projection with a clearance, a groove in each opposed face of the ring segments, each groove having a depth at least as great as the length of the projection or the depth of the recess, and a flat plate within each two opposed grooves, and (c) means for applying resilient pressure in a radially outward direction to the sealing ring segments so as to press the radially outer faces of the segments against the free ends of the vanes, thereby forming a seal.

2. A sealing device as defined in claim 1 wherein the means for applying resilient pressure includes spring means located between the sealing ring segments and the stator section.

3. A sealing device as defined in claim 2 wherein the spring means comprises corrugated spring segments arranged around the periphery of the stator section, the spring segments being overlapped at their adjacent edges.

4. A sealing device as defined in claim 1 wherein the means for applying resilient pressure includes compressed air.

5. A sealing device as defined in claim 1 wherein the outer surfaces of the sealing ring segments and the free ends of the vanes are curved in the axial direction of the stator, the radius of curvature of the ring segments being smaller than that of the vane ends, so that each ring segment engages its respective vane end over only a portion of its surface.

* * * * *